US008230980B2

(12) United States Patent
Mason

(10) Patent No.: US 8,230,980 B2
(45) Date of Patent: Jul. 31, 2012

(54) METHOD OF OPERATING ELEVATORS DURING EMERGENCY SITUATIONS

(75) Inventor: Christopher John Mason, Ledgewood, NJ (US)

(73) Assignee: Inventio AG, Hergiswil (CH)

( * ) Notice: Subject to any disclaimer, the term of this patent is extended or adjusted under 35 U.S.C. 154(b) by 422 days.

(21) Appl. No.: 12/651,094

(22) Filed: Dec. 31, 2009

(65) Prior Publication Data

US 2011/0155516 A1 Jun. 30, 2011

(51) Int. Cl.
*B66B 1/16* (2006.01)

(52) U.S. Cl. ..... 187/388; 187/384; 187/387

(58) Field of Classification Search ..... 187/247, 187/248, 313, 316, 317, 380–388, 391–393
See application file for complete search history.

(56) References Cited

U.S. PATENT DOCUMENTS 6,000,505 A * 12/1999 Allen ..... 187/391
7,461,723 B2 * 12/2008 Kawai ..... 187/313
7,588,126 B2 * 9/2009 Siikonen et al. ..... 187/384
7,594,564 B2 * 9/2009 Siikonen et al. ..... 187/384
7,621,378 B2 * 11/2009 Kawai ..... 187/313
7,637,354 B2 * 12/2009 Kawai ..... 187/313
7,669,695 B2 * 3/2010 Hikita et al. ..... 187/284
7,677,363 B2 * 3/2010 Kawai ..... 187/387
7,743,889 B2 * 6/2010 Kawai ..... 187/313

* cited by examiner

*Primary Examiner* — Anthony Salata
(74) *Attorney, Agent, or Firm* — Wolff & Samson, PC

(57) ABSTRACT

An elevator system having at least two elevators, wherein at least one of the elevators is designated as an emergency personnel elevator, can be operated to allow a firefighter to commandeer a second elevator for the purpose of ferrying persons to a safe evacuation floor. The elevator system is configured to determine if a request for an evacuation elevator originates from the firefighter elevator car positioned at one of several floors of a building. In response to the request, an elevator car other than the emergency personnel elevator car is designated as the evacuation elevator car. Further, the evacuation elevator car is dispatched to the floor the emergency personnel elevator car is positioned, and the evacuation elevator car is dispatched to a predefined evacuation floor upon receipt of an evacuation request made by the firefighter.

18 Claims, 3 Drawing Sheets

METHOD OF OPERATING ELEVATORS DURING EMERGENCY SITUATIONS

BACKGROUND OF THE INVENTION

The various embodiments described herein generally relate to elevator systems. More particularly, the various embodiments described herein relate to a system and method for operating elevator systems during emergency situations in order to evacuate building occupants from a multi-story building having a plurality of floors.

U.S. Pat. No. 6,000,505 discloses that the 1996 Edition of the ASME A17.1 code for elevators requires recall of all elevators, i.e., in an emergency situation such as a fire situation, all hall call stations are de-energized and all elevators (i.e., its elevator cars) are automatically recalled to a predesignated floor of the building. The elevators cars are parked with the doors open and the elevators are temporarily taken out of service. Upon arrival, the fire department can override the recall function by activating a fire department key switch to utilize each elevator car individually. To improve evacuation efficiency, U.S. Pat. No. 6,000,505 discloses an emergency elevator evacuation control system that allows the use of the elevators as a means of egress and evacuation during an emergency situation, even before the fire department arrives.

Evacuation procedures, however, may prescribe that the evacuation of persons via an elevator car may take place only under control and supervision of the fire department. According to these procedures, a firefighter overrides the recall function of an elevator and uses that elevator to travel throughout the building to inspect the floors or to evacuate persons. In the process of evacuating persons, the elevator and firefighter are reserved and, hence, unavailable for other use until the evacuation of the building is completed.

SUMMARY OF THE INVENTION

There is, therefore, a need for increasing the evacuation capacity, whilst avoiding violations of current evacuation procedures. Accordingly, the various embodiments disclosed herein describe a system and a method for operating an elevator system in conjunction with an emergency situation. More particularly, these embodiments allow the firefighter to commandeer a second elevator for the purpose of ferrying persons to a safe evacuation floor.

One aspect of the invention involves a method of operating an elevator system having at least two elevators in conjunction with an emergency situation, wherein at least one elevator car is designated as an emergency personnel elevator car. The method determines if a request for an evacuation elevator originates from the emergency personnel elevator car positioned at one of several floors of a building. The method dispatches at least one elevator car as an evacuation elevator car to the floor the emergency personnel elevator is positioned. Further, the method dispatches the evacuation elevator car to a predefined evacuation floor upon receipt of an evacuation command.

Another aspect involves an elevator system having at least two elevators in conjunction with an emergency situation, wherein at least one is designated as an emergency personnel elevator car. The elevator system has an operating panel within the emergency personnel elevator car configured to allow input of a request for an evacuation elevator car, and an elevator control system coupled to the operating panel and configured to communicate with the operating panel. The elevator control system is configured to determine if the request for an evacuation elevator car originates from the emergency personnel elevator car positioned at one of several floors of a building, and to dispatch at least one elevator car as an evacuation elevator car to the floor the emergency personnel elevator car is positioned. Further, the elevator control system is configured to dispatch the evacuation elevator car to a predefined evacuation floor upon receipt of an evacuation command.

The method and system can be configured to allow emergency personnel, e.g., a firefighter, to repeatedly request an evacuation elevator until all building occupants are evacuated from a floor, or the building.

The evacuation of each floor occurs under control and authority of a firefighter. The firefighter's authority reduces the risk of panic among a group of frightened building occupants anxious to leave the floor. If the building occupants are not in panic, the boarding of the elevator car occurs in a more controlled manner allowing a maximum number of people to board. This avoids the problem of overloading the elevator car or blocking the doors of the elevator car, which may hinder the elevator from operating. If the firefighter releases the evacuation elevator car, i.e., sends a command to the group controller to send the evacuation elevator car to the evacuation floor, and remains on the floor, the firefighter can ensure that the doors close and the elevator car leaves the floor.

BRIEF DESCRIPTION OF THE SEVERAL VIEWS OF THE DRAWINGS

The novel features and method steps characteristic of the invention are set out in the claims below. The invention itself, however, as well as other features and advantages thereof, are best understood by reference to the detailed description, which follows, when read in conjunction with the accompanying drawings, wherein:

DETAILED DESCRIPTION OF THE INVENTION

Figure 1:
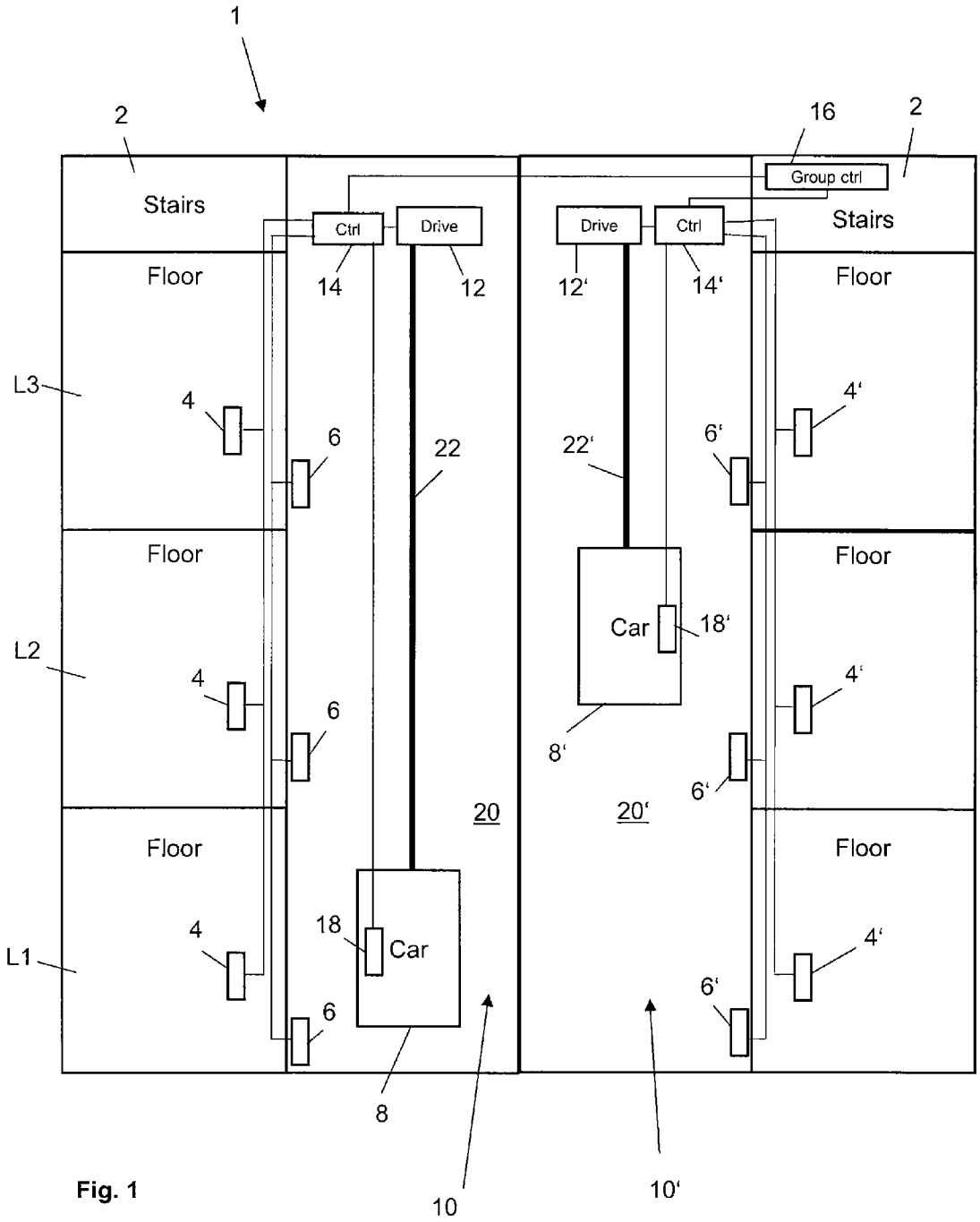
FIG. 1 shows a schematic illustration of one embodiment of an elevator system within a building and configured to provide for an increased evacuation capacity.

FIG. 1 illustrates one embodiment of an elevator system 1 installed in a multi-story building and configured to operate during emergency situations to allow efficient and safe evacuation of building occupants from the multi-story building. The various embodiments described herein relate to an emergency situation caused by fire, wherein emergency personnel, e.g., firefighters follow an established procedure to screen a building and evacuate persons from the building, if necessary. It is, however, contemplated that other emergency situations may likewise require fast and efficient evacuation of the building under control of emergency personnel, such as an earthquake, a bomb thread, a hurricane etc.

Building users and occupants have access and egress to the various floors L1, L2, L3 of the building either by stairways 2 or by individual elevators 10, 10'. In the illustrated embodiment, the elevator system 1 includes two elevators 10, 10' arranged, e.g., parallel and adjacent to one another. Each elevator 10, 10' includes an associated elevator car 8, 8' and a control system 14, 14' that acts on a drive 12, 12' to move the elevator car 8, 8', for example suspended by one or more tension members 22, 22', in an elevator shaft 20, 20', from one of the floors L1, L2, L3 to another. A tension member 22 may by a steel rope having a round cross-section, or a group of (steel or non-metallic) cords embedded in synthetic material having a non-round cross-section, e.g., a rectangular cross-section. In the illustrated embodiment, several sensors 6, 6' are disposed in the shaft 20, 20' at or near the floors L1, L2, L3 and coupled to the respective control system 14, 14'. The sensors 6, 6' are configured to detect the proximity of an elevator car 8, 8' and to generate corresponding sensor signals. The control system 14, 14' uses the generated sensor signals to determine a current location of an elevator car 8, 8'. It is contemplated that the elevator system 1 may be configured to determine the location of an elevator car 8, 8' in different way. For example, the location may be determined via sensing equipment on the elevator car 8, 8', or via a system that uses information provided on the tension member 22.

Generally, the physical structure of the elevator system 1 corresponds to the physical structure of a conventional elevator system. In one embodiment, the physical structure includes in addition to the mentioned elements (control system 14, 14, drive 12, 12' and tension member 22, 22') a counterweight, guide rails for the elevator cars 8, 8' and the counterweight, safety equipment such as brakes and safety circuits for door mechanisms, etc. It is contemplated that, depending on a particular embodiment of the elevator system 1, the configuration and disposition of these elements in the shaft 20, 20' may vary. For example, the drive 12, 12' may be arranged in a separate machine room or directly in the shaft 20, 20' ("machine room less elevator") at the top, as shown, or at the bottom of the shaft 20, 20'.

In the illustrated embodiment, the two elevators 10, 10' are defined as a group or bank under control of a group controller 16, wherein the group controller 16 is coupled to the control system 14, 14' of each elevator 10, 10'. The control system 14, 14' and the group controller 16 form the elevator control system. In another embodiment, the group controller, or its functionality, is integrated in at least one of the control systems 14, 14' so that that control system 14, 14' handles the control of its assigned individual (single) elevator 10, 10' as well as the control of the group of elevators 10, 10'. If each control system 14, 14' includes the functionality of a group controller, and that functionality is active in only one control system 14, 14' at a time, the inactive group controller, or its functionality can be activated to take over the control of the group in case of a failure of the currently active group controller (or functionality). Advantageously, this provides redundancy of the group controller functionality.

The group controller 16 and the control systems 14, 14' include (micro)processors and associated electronic circuitry such as interfaces, special purpose integrated circuits (ASICs), power supplies, and memories/storage devices. The processors are programmed to execute specified control algorithms and procedures. For example, the group controller 16, or its functionality when implemented in a control system 14, 14', is configured and programmed to execute the method illustrated in the flow chart of FIG. 3 and variations thereof as described herein. Hereinafter, the group controller 16 is described as a separate entity; however, it is contemplated that the functionality of the group controller 16 may be implemented in the control systems 14, 14', as mentioned above.

Generally, the group controller 16 serves as a central coordinator for the actions and operation of one or more elevators 10, 10'. The group controller 16 collects and stores information about the status of the individual elevators 10, 10' within its scope of supervision. Individual elevators 10, 10' update the group controller 16 with status information about their availability for any group operation, location, speed, door status, current operating mode (e.g., automatic, manual, one of several special services, defective/unavailable), and passenger requests to be processed, e.g. car calls etc.

The group controller 16 makes use of the information received to determine an "optimal" elevator 10, 10' to serve a passenger request (e.g., floor calls or destination based requests) and dispatches the selected elevator 10, 10' to the position of the requesting passenger. The dispatching is a dynamic process and the group controller 16 is constantly optimizing the dispatching so that, should the case arise that the originally dispatched elevator 10, 10' becomes engaged in a different mode of operation, is delayed from travelling or becomes unavailable, the group controller 16 can select and dispatch a different elevator 10, 10'.

The group controller 16 also manages special operating modes specific to the elevator group. These special operating modes include, but are not limited to, fire emergency evacuation, emergency power operation, parking of cars during quiescent periods and selection of cars for special passenger requests. The group controller 16 also plays an active part in communicating and coordinating group operation with building management systems and other elevator groups.

Hence, the group controller 16 "knows" the status of each elevator 10, 10', i.e., the current location of the elevator cars 8, 8', whether the elevator cars 8, 8' are moving up or down to respond to a call, current load, and other operational parameters. The current location of each elevator car 8, 8' is detected, e.g., by way of the sensors 6, 6' at the floors L1, L2, L3 that communicate position-indicative signals to the respective control system 14, 14'. In another embodiment, an elevator car 8, 8' may be equipped with a sensor generating a position-indicative signal, the elevator system 1 may be equipped with any other system providing position information. For example, when a passenger places a call at one of the floors L1, L2, L3, the group controller 16 selects, in view of the operational parameters, a suitable elevator 10, 10' to service that call. A suitable elevator 10, 10' is, e.g., one whose car 8, 8' is closest to the floor L1, L2, L3 where the passenger is waiting or one whose car 8, 8' is already moving in the same direction the passenger wants to go to minimize delay due to stops.

Each control system 14, 14' is connected to the drive 12, 12' of the elevator 10, 10'. The drive 12, 12' acts on the tension member 22, 22' to move the elevator car 8, 8', as is known in the art. The elevator control system, e.g., the control systems 14, 14', either directly or via the group controller 16, may be in communication with at least one of a remote control unit in a remote service center, a police station, a fire station and a remote building management center. In this case, the elevators 10, 10' and other elements of the building, such as doors, lights or windows, can be remotely monitored and controlled in case of an emergency, for example, via the public telephone network or any other network that is reliable under emergency conditions.

Further, at the building management center, the status of the elevator system 1 may be displayed on a status panel. In case of an emergency situation, the displayed status may include, for example, the location of the firefighter elevator, if the firefighter requested an evacuation elevator car, if an evacuation car has been selected and is on its way, and if the firefighter sent a command to send the evacuation car to the evacuation floor, or any other information indicative of the status of the elevator system. In certain embodiments, personnel at the building management center may use the status information to control or monitor a certain elevator 10, 10' (e.g., the traveling of the evacuation elevator) or to inform/update the firefighters at the building.

It is contemplated that the elevator system 1 may have more than two elevators 10, 10', and that the group controller 16 is then configured to control a group of more than two elevators. Furthermore, in certain embodiments of the elevator system 1 more than one elevator car may be traveling in a shaft or an elevator car may be configured as a multi-deck car.

At least one operating panel 4, 4', also known as landing operating panel (LOP), is installed at each floor L1, L2, L3 and coupled to the elevator control system, e.g., directly to the control system 14, 14', and to communicate with the operating panel 4, 4'. Depending on a particular configuration of the elevator system 1, the operating panel 4, 4' allows a passenger to call an elevator car by pressing, e.g., the "up" or "down" button, or by entering a desired destination via an input device (e.g., a touch screen or a keypad). The operating panel 4, 4' may include an electronic reader device configured to read information from a card or badge a passenger is required to place next to the electronic reader device in order to call an elevator car. The electronic reader device may be configured to read a barcode from the badge or to poll an information storing RFID device on the badge. It is contemplated that the operating panel 4, 4' is designed and equipped to be suitable for a particular configuration of the elevator system 1.

In case of an emergency situation, the operating panel 4, 4' is usually either deactivated or any input made at the operating panel 4, 4' is disregarded because of the risk of its malfunctioning due to the fire situation. In certain embodiments of the elevator system 1 or the building's communications system, a floor may be equipped with a one-way or two-way communications system (e.g., a loudspeaker and a microphone) coupled to the building management center. In an emergency situation, the communications system may be used for communications between personnel at the building management center and a building occupant at the floor.

Figure 2:
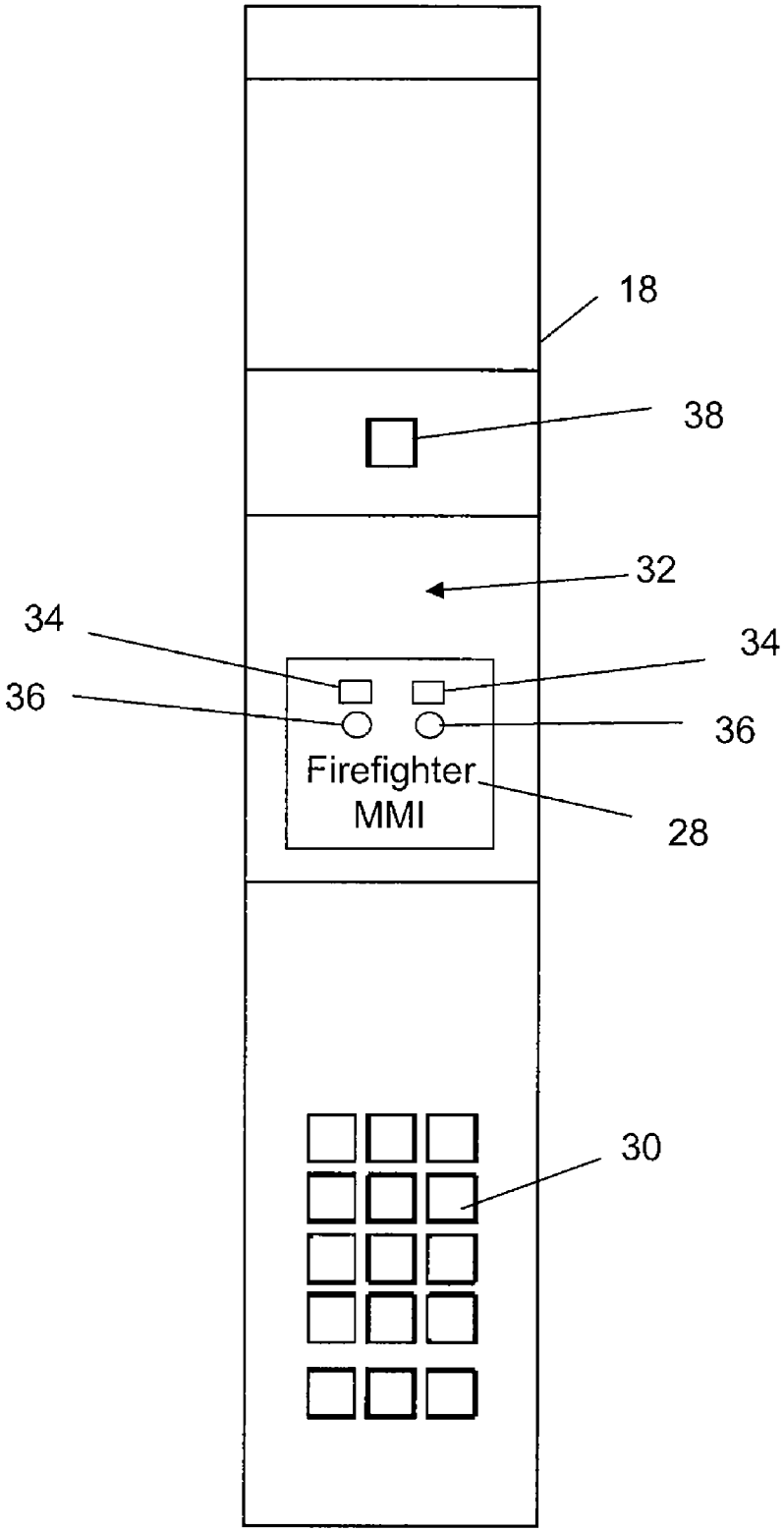
FIG. 2 is a schematic illustration of one embodiment of an operating panel within an elevator car configured to allow emergency personnel to commandeer another elevator car.

FIG. 2 is a schematic illustration of one embodiment of an operating panel 18, 18' within an elevator car 8, 8' and configured to allow emergency personnel to commandeer another elevator car. Within each elevator car 8, 8', the operating panel 18, 18' is mounted to or integrated in an interior wall and coupled to the control system 14, 14'. The operating panel 18, 18' is also known as car operating panel (COP). Depending on a particular configuration of the elevator system 1, the operating panel 18, 18' allows a passenger to enter a desired destination, e.g., via a keypad 30 shown in FIG. 2. Independent of the particular configuration of the elevator system 1 are other conventional functions of the operating panel 18, 18', such as an alarm or SOS function, a communication function (speak and listen) and an indicator 38 for a floor (number) and/or travel direction ("up", "down").

Furthermore, some countries such as the USA require the operating panel 18, 18' to have a fire department function that allows a firefighter to operate the elevator car 8, 8' during an emergency situation. In one embodiment of the operating panel 18, 18', the fire department function is centralized in a locked compartment 32 of the operating panel 18, 18'. This compartment 32 is also known as "hidden box", hidden from and not accessible by passengers. For illustrative purposes, FIG. 2 shows the compartment 32 without a cover so that a man-machine interface (MMI) 28 (hereinafter referred to as "MMI 28") is visible in FIG. 2. The compartment 32 includes, for example, a fire department key switch, individual buttons to enter a destination floor, and buttons to open and close the door.

To enable a firefighter, or any other emergency personnel, to commandeer a second elevator for the purpose of ferrying persons to a safe evacuation floor to more efficiently evacuate the building, the operating panel 18, 18' (or its "hidden box") has a dedicated function in addition to its conventional firefighter MMI 28 that allows a firefighter to operate the elevator car 8, 8'. This dedicated function allows the firefighter to request another elevator car to his current location. The dedicated function may be implemented in various ways: as at least one separate button 34, or key switch, on the MMI 28 or at another position within the compartment 32, or as an additional function on an existing button (e.g., the firefighter presses the button of the floor he is currently checking, which the control system 14, 14' and/or the group controller 16 interpret as a request for another elevator car 8, 8' to be sent to that floor).

The operating panel 18, 18' has in one embodiment a receiver to receive messages or signals dispatched from the control system 14, 14' in response to the firefighter's request and at least one output device 36 to communicate a message to the firefighter. The message includes at least request status (e.g., "elevator dispatched", "elevator has arrived" or "no elevator available"), an elevator identification (e.g., an elevator number), or a combination thereof. The output device 36 may generate a visual output (e.g., via a display or a light source (e.g., color-coded and/or flashing (LED) lamps)), an audio output corresponding to the message (a recorded or live announcement), or a combination thereof.

In the embodiment of FIG. 2, the output device 36 is a light source arranged below the button 34 so that the button 34 and the output device 36 form a pair. Further, FIG. 2 shows another button—output device pair next to the other pair. It is contemplated that the output device 36, or its functionality, may be integrated in the button 34, for example, the button 34 may have an integrated light source. In that embodiment, the MMI 28 does not have a separate output device.

In one embodiment, the receiver, button 34 and the output device 36 are integrated in the MMI 28. It is contemplated, however, that the car's communication system, or at least its loudspeaker, may be used as an output device for audio messages. In that case, the MMI 28 may not have a separate output device.

The MMI 28 may be configured in various ways. In one embodiment, the MMI 28 has one button 34 for both requesting an evacuation elevator car and releasing the evacuation elevator car once it is ready for being dispatched to the evacuation floor. The output device 36, under control of at least one of the control systems 14, 14' and the group controller 16, confirms the request for an evacuation elevator car. For example, a flashing light source of the output device 36 may indicate that the requested evacuation elevator car is on its way, and a constant (e.g., green) light may indicate that the car has arrived and is waiting at the floor. Similarly, once the evacuation elevator car has been released, the light source may flash with a different frequency or different color to indicate that it is on its way to the evacuation floor. A constant light indicates that the car arrived at the evacuation floor.

In another embodiment, the MMI 28 has one ("request") button 34 for requesting an evacuation elevator car, and another ("release") button 34 for releasing the evacuation elevator car. Each button 34 has an associated output device 36 ("request" and "release", respectively) for informing the firefighter about the status of the respective request. The light source of the output device 36 operates as previously described. For example, the "request" output device 36 communicates a message concerning the status of the evacuation elevator car after dispatch of the evacuation elevator car, and the "release" output device 36 communicates a message concerning the status of the evacuation elevator car after dispatch of the evacuation elevator car to the predefined evacuation floor.

Furthermore, the button 34 has in one embodiment a (e.g., numbered) dial to select one of the elevators 10, 10' by turning the dial. Once the selection is made, the button 34 is configured to be pressed by the firefighter to request an evacuation elevator.

In yet another embodiment, the MMI 28 is configured to provide more information to the firefighter. For example, the MMI 28 may have a display or other output device to display the message, e.g., "elevator dispatched", "elevator has arrived" or "no elevator available", and/or any other information deemed necessary for the firefighter and his screening task.

Figure 3:
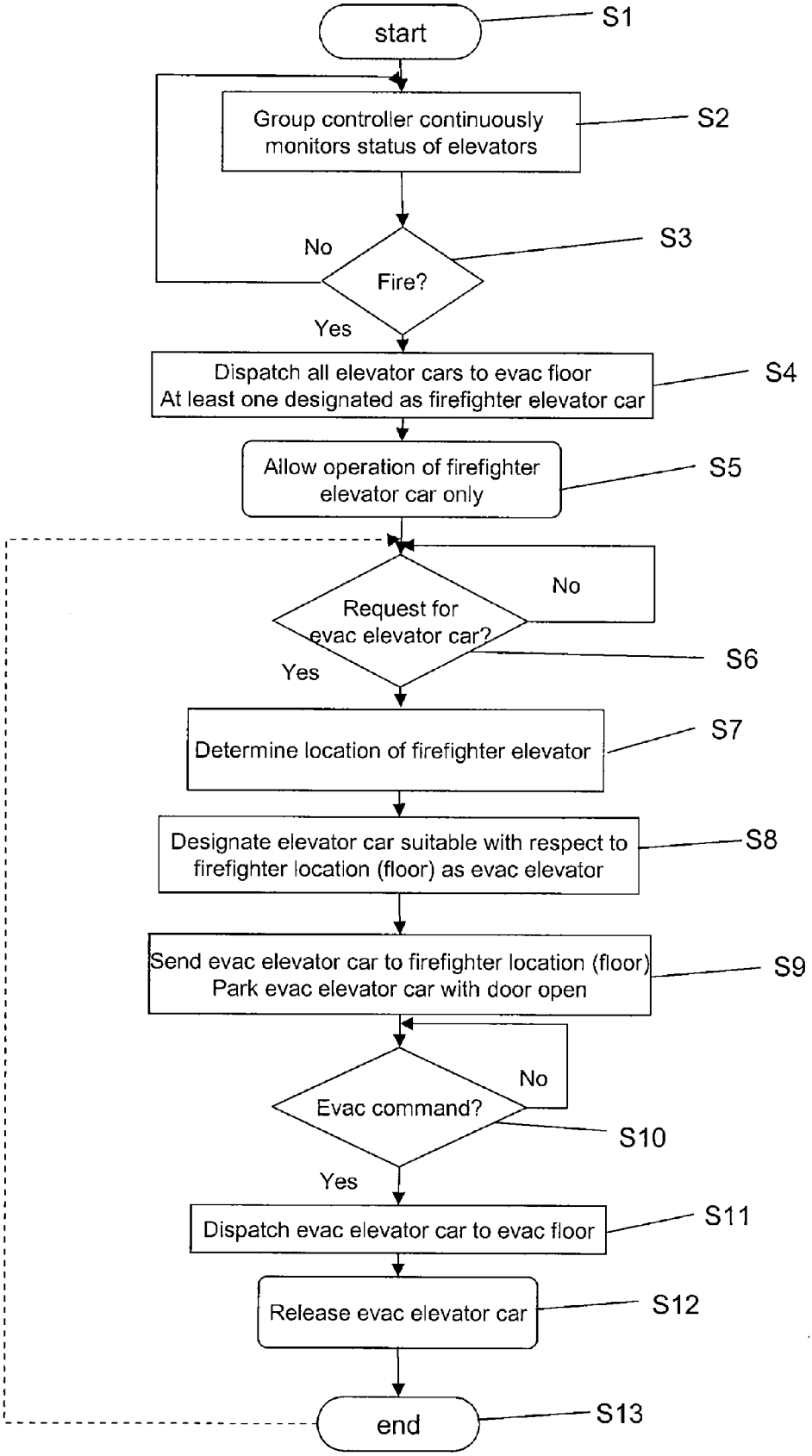
FIG. 3 is a flow diagram of one embodiment of a method of operating an elevator system during an emergency situation.

FIG. 3 is a flow diagram of one embodiment of a method of operating the exemplary elevator system 1 of FIG. 1 during an emergency situation. An emergency situation exists, for example, when one of the detectors installed within the building as part of the building's fire alarm system is triggered by smoke, heat, gas or any other parameter indicative of a fire or a beginning fire, and generates a signal indicative of fire situation. In such a situation, the elevator system 1 is switched from a normal operation mode to an emergency mode via the control system 14, 14' and the group controller 16. The various steps of the method are described herein for a fire situation and from the perspective of the group controller 16, which is configured to operate in accordance with the method. The method begins at step S1 and ends at step S13.

Referring to a step S2, the elevator system 1 operates in normal operation mode, wherein the group controller 16 continuously monitors the status of each elevator 10, 10'. Due to that monitoring, the group controller 16 "knows" the various operational parameters of the elevators 10, 10', as mentioned above, and can assign a suitable elevator 10, 10' in response to a call.

Proceeding to a step S3, the method determines if a fire situation or any other situation exists that may affect safe operation of the elevator system 1. If there is no such alarm, the method returns along the NO branch to step S2. If, however, the building's fire alarm system issued an alarm, the method proceeds along the YES branch to a step S4.

In step S4, the group controller 16 recalls all elevator cars 8, 8' to a pre-designated evacuation ("evac") floor of the building, e.g., the lobby with exits from the building. The elevator cars 8, 8' are parked with the doors open, and the elevators 10, 10' are temporarily taken out of service. Upon arrival, the fire department can override the recall function by activating the fire department key switch to utilize an elevator car 8, 8' individually. In a group of elevators, at least one elevator is typically designated as a firefighter elevator. The firefighter elevator is equipped to operate in a fire situation, e.g., it has fire retardant material and/or (additional) filters installed in vents.

Proceeding to a step S5, the group controller 16 allows operation of only the firefighter elevator once the firefighter overrides the recall function using the operation panel 18, 18' within the elevator car 8. 8'. The firefighter uses the firefighter elevator to screen the building on a floor by floor basis, e.g., up to one or two floors below the floor that reported a fire condition. That is, the firefighter stops the elevator car 8, 8' at each floor L1, L2, L3, checks if it is safe to open the elevator car 8, 8', and, if it is safe, checks if any building occupants need to be evacuated.

Proceeding to a step S6, the group controller 16 determines if a request for an evacuation elevator car has been sent. As described herein, the elevator car 8, 8' the firefighter uses is configured to allow the firefighter via the MMI 28 to request an evacuation elevator car to be dispatched to his current location (floor). If the firefighter requires an evacuation elevator car to evacuate building occupants, the firefighter presses, for example, a designated button (e.g., button 34 in FIG. 2) in the compartment 32 (hidden box), and the method proceeds along the YES branch to a step S7. If no evacuation is required, no request is sent; the method remains in a waiting mode in step S6 (NO branch).

In step S7, the group controller 16 determines the location of the firefighter elevator. As mentioned with reference to step S2, the group controller 16 knows the status of any elevator 10, 10' in operation. For example, the group controller 16 stores status information, including the location, of each elevator in a memory from which the location information may be retrieved, if required.

Proceeding to a step S8, the group controller 16 designates an elevator car suitable with respect to the location of the firefighter elevator as an evacuation elevator car. In one embodiment, the evacuation elevator car is one of the elevator cars parked at the pre-designated evacuation floor.

Proceeding to a step S9, the group controller dispatches the designated evacuation elevator car to the firefighter's locations and parks it with open doors. Building occupants that need to be evacuated can now board the car under control and authority of the firefighter.

Proceeding to a step S10, the group controller 16 determines if an evacuation command has been sent. Once all occupants have boarded the car, or the car is full, the firefighter issues the evacuation command, either from the firefighter elevator car, or from the evacuation elevator car. For example, the firefighter may continue screening the building as soon as the evacuation elevator car is on its way to the evacuation floor. In the alternative, if there are still occupants on that floor, the firefighter may request another evacuation elevator car to be sent to that floor. The method would then perform steps S8-S10 again. If the group controller 16 determines that the firefighter sent an evacuation command the method proceeds along the YES branch to a step S11, otherwise it waits (NO branch).

Proceeding to step S11, the group controller S11 sends the evacuation elevator car to the evacuation floor. At the evacuation floor, the evacuated building occupants are received by other firefighters. As soon as the evacuation elevator car is empty, the evacuation elevator car is released, as shown in a step S12.

In step S13, the method ends. The method, however, may be repeated as indicated by a dashed line leading to step S6.

Having described certain embodiments of the elevator system 1 and the method of operating the elevator system 1 during an emergency situation it is contemplated that the elevator system 1 and/or the method of operating may be modified depending on certain requirements. For example, the elevator system 1 may be configured to allow the firefighter to request more than one evacuation elevator car at the same time to its current floor. This may be desirable in a situation where the firefighter arrives at a floor with a lot of waiting building occupants, or has received advance information, e.g., via the car's communications system, that a lot of building occupants are waiting.

To be prepared for such a case, the MMI 28 may have several buttons 34 and output devices 36, each pair assigned to a different elevator. The buttons 34 may be marked with the identification (e.g., letters or numbers) of the elevators. The firefighter may be instructed to select a neighboring elevator, or the group controller 16 is configured to assign an elevator car arriving in proximity of the firefighter elevator, e.g. a neighboring elevator, but not one in another aisle, so that the firefighter can supervise boarding of all evacuation elevator cars, which is beneficial, for example, with limited visibility due to smoke.

Further, as an alternative to the designation of a car parked at the evacuation floor described in step S8, the group controller 16 may designate any other suitable elevator car as an evacuation elevator. For example, the group controller 16 may select an elevator car that is close to the firefighter's current location and still has capacity to accept additional passengers. That elevator car may be operated, for example, by another firefighter.

It is apparent that there has been disclosed a system and method for operating an elevator system during emergency situations that fully satisfy the objects, means, and advantages set forth herein before. For example, emergency personnel can more efficiently evacuate a building and repeatedly request an evacuation elevator car until all building occupants are evacuated from a floor, or the building. As soon as emergency personnel release the evacuation elevator car, the emergency personnel can continue screening the building without having to use the firefighter elevator for the evacuation.

Furthermore, it is contemplated that the elevator system 1 and/or its group controller 16 may be configured to allow efficient and safe evacuation of a building even if the designated firefighter elevator becomes inoperable. In that case, the firefighter can use the MMI 28 to request an evacuation elevator, and upon its arrival remove the firefighter key from the now inoperable firefighter elevator and leave this firefighter elevator. The firefighter can, then, insert the firefighter key into the panel of the evacuation elevator car, thereby overriding the evacuation function and registering the elevator as the new designated firefighter elevator.

What is claimed is:

1. A method of operating an elevator system having at least two elevators in conjunction with an emergency situation, wherein at least one elevator car is designated as an emergency personnel elevator car, comprising:

determining if a request for an evacuation elevator car originates from an emergency personnel elevator car positioned at one of several floors of a building;

dispatching an elevator car as an evacuation elevator car to the floor the emergency personnel elevator car is positioned; and dispatching the evacuation elevator car to a predefined evacuation floor upon receipt of an evacuation command.

2. The method of claim 1, wherein the evacuation command originates from the emergency personnel elevator car.

3. The method of claim 1, wherein the evacuation command originates from the evacuation elevator car.

4. The method of claim 1, further comprising opening a door of the evacuation elevator car at the floor to which it has been dispatched.

5. The method of claim 1, further comprising dispatching a message to the emergency personnel elevator car, wherein the message includes at least one of request confirmation and elevator identification.

6. The method of claim 5, further comprising communicating the message in the emergency personnel elevator car.

7. The method of claim 6, wherein communicating the message includes at least one of generating a visual output and generating an audio output corresponding to the message.

8. The method of claim 1, further comprising designating an elevator car other than the emergency personnel elevator car as the evacuation elevator car in response to the request for an evacuation elevator car.

9. The method of claim 8, wherein designating an elevator car includes selecting an elevator car configured to arrive in proximity of the emergency personnel elevator car.

10. The method of claim 8, wherein designating an elevator car includes selecting an elevator car close to the floor the emergency personnel elevator car is positioned, and having capacity to accept passengers.

11. A system for operating an elevator system having at least two elevators in conjunction with an emergency situation, wherein at least one elevator car is designated as an emergency personnel elevator car, comprising:

an operating panel within the emergency personnel elevator car configured to allow input of a request for an evacuation elevator car; and an elevator control system coupled to the operating panel and configured to communicate with the operating panel, wherein the elevator control system is configured:

to determine if the request for an evacuation elevator car originates from the emergency personnel elevator car positioned at one of several floors of a building;

to dispatch an elevator car as an evacuation elevator car to the floor the emergency personnel elevator car is positioned; and to dispatch the evacuation elevator car to a predefined evacuation floor upon receipt of an evacuation command.

12. The system of claim 11, wherein the operating panel includes a man-machine interface having at least one input device for requesting the evacuation elevator car and for inputting the evacuation command.

13. The system of claim 12, wherein the operating panel includes at least one output device to communicate a message concerning a status of the evacuation elevator car.

14. The system of claim 13, wherein the input device and the output device are integrated as a single device.

15. The system of claim 13, wherein the output device is configured to generate at least one of a visual output and an audio output.

16. The system of claim 11, wherein the operating panel includes a man-machine interface having a first input device for requesting the evacuation elevator car and a second input device for inputting the evacuation command.

17. The system of claim 16, wherein the operating panel includes a first output device to communicate a first message concerning a status of the evacuation elevator car after dispatch of the evacuation elevator car to the floor the emergency personnel elevator car is positioned, and a second output device to communicate a second message concerning a status of the evacuation elevator car after dispatch of the evacuation elevator car to the predefined evacuation floor.

18. The system of claim 11, wherein the elevator control system is further configured to designate an elevator car other than the emergency personnel elevator car as the evacuation elevator car in response to the request for an evacuation elevator car.

* * * * *